US011878257B2

(12) United States Patent
Ricottone

(10) Patent No.: US 11,878,257 B2
(45) Date of Patent: Jan. 23, 2024

(54) KIT FOR FORMING CRAFTS FROM A MOLDABLE MATERIAL

(71) Applicant: Spin Master Ltd., Toronto (CA)

(72) Inventor: Jamie Ricottone, Burlington (CA)

(73) Assignee: SPIN MASTER LTD., Toronto (CA)

( * ) Notice: Subject to any disclaimer, the term of this patent is extended or adjusted under 35 U.S.C. 154(b) by 226 days.

(21) Appl. No.: 17/645,166

(22) Filed: Dec. 20, 2021

(65) Prior Publication Data

US 2023/0191273 A1 Jun. 22, 2023

(51) Int. Cl.
*A63H 33/00* (2006.01)

(52) U.S. Cl.
CPC ..... *A63H 33/001* (2013.01)

(58) Field of Classification Search
CPC ..... A63H 33/001
See application file for complete search history.

(56) References Cited

U.S. PATENT DOCUMENTS

| | | | |
|---|---|---|---|
| 2,874,649 | A | 2/1959 | Pelletier |
| 3,157,933 | A | 11/1964 | Boggild et al. |
| 3,264,685 | A | 8/1966 | Boggild et al. |
| 3,892,510 | A | 7/1975 | Meth et al. |
| 4,199,311 | A | 4/1980 | Ferris et al. |
| 4,815,961 | A | 3/1989 | Kindred |
| 5,409,364 | A | 4/1995 | Schultheis et al. |
| 5,413,472 | A | 5/1995 | Dietterich et al. |
| 5,954,561 | A | 9/1999 | Cannone |
| 6,602,066 | B1 | 8/2003 | Heayes |
| 7,416,400 | B1 | 8/2008 | Mangelsen |
| 8,226,399 | B2 | 7/2012 | Dufaux et al. |
| 8,506,283 | B1 * | 8/2013 | Gonzales ..... A21C 9/06 425/401 |
| 8,512,613 | B2 | 8/2013 | Dufaux et al. |
| 8,882,488 | B2 | 11/2014 | Schultheis et al. |
| 9,474,986 | B2 | 10/2016 | Drylie |
| D874,580 | S | 2/2020 | Mccloskey et al. |
| 2019/0381740 | A1 | 12/2019 | Moll et al. |
| 2020/0038770 | A1 | 2/2020 | Sambatti |
| 2020/0368632 | A1 | 11/2020 | Loik |

FOREIGN PATENT DOCUMENTS

| | | | |
|---|---|---|---|
| CN | 104225929 | A | 12/2014 |

OTHER PUBLICATIONS

CN104225929 English Translation.

* cited by examiner

*Primary Examiner* — James Sanders
(74) *Attorney, Agent, or Firm* — Aird & McBurney LP

(57) ABSTRACT

In an aspect, a kit for forming crafts from a moldable material is provided. The kit includes a housing with a molding passage therethrough that holds a volume of moldable material. The housing includes open first and second axial ends for insertion therein of a core element connected to a plunger element. The core element includes a passage with an open end, such that when the core element is inserted through one of the axial ends and into the volume of the moldable material in the molding passage, the passage can capture a core quantity of the moldable material therein, and remove the core quantity of the moldable material from housing. The plunger element is also formed to be inverted and inserted through one of the first and second axial ends to extrude a quantity of the moldable material out through the other of the axial ends of the housing.

12 Claims, 8 Drawing Sheets

KIT FOR FORMING CRAFTS FROM A MOLDABLE MATERIAL

FIELD OF THE INVENTION

The present invention relates generally to kits of molds or stencils. More specifically, the present invention relates to a kit for forming crafts from a moldable material.

BACKGROUND OF THE INVENTION

Traditionally, when children want to form shapes and objects from a modeling compound or molding material such as clay or dough, they will either rely on free forming of the molding material with their hands, or will make use of typical household items that can be used for molding or cutting, such as cookie cutters, scissors, and the like.

If a child wants to make a more intricate colorful craft from a molding material, the molding material that has been molded or cut into different, independent objects or shapes can be further manipulated so as to combine the different shapes and achieve a molded product having a varying form, color or design pattern. Due to the relatively free-hand methods of forming the objects or shapes and combining the objects or shapes, the resulting molded product may have a design pattern or form that is difficult to repeatedly form in a uniform and consistent manner.

It is therefore an object of the invention to provide a novel kit for forming crafts from a molding material.

SUMMARY OF THE INVENTION

According to an aspect, there is provided a kit including a housing and a plunger element. The housing has a molding passage therethrough for holding a volume of the moldable material. The housing has a first axial end that is open to the passage and a second axial end that is open to the molding passage. The housing is formed of a plurality of releasably connectable housing portions that together define the molding passage. The plunger element includes a pressing surface on a first side thereof and a core element extending from an opposing, second side thereof. The core element has a core element passage therein and having a first end that is open to the core element passage. The core element is sized to be inserted through one of the first and second axial ends of the housing and into the volume of the moldable material that is, in use, held within the molding passage so as to capture a core quantity of the moldable material within the core element passage for removal from the volume of the moldable material that is in the molding passage. The plunger is sized to be inserted through one of the first and second axial ends and into the molding passage to extrude an extruded quantity of the moldable material out through the other of the first and second axial ends of the housing.

According to another aspect of the invention, there is provided a kit for forming crafts from a moldable material. The kit includes a housing having a molding passage therethrough for holding a volume of the moldable material. The housing has a first axial end that is open to the passage and a second axial end that is open to the molding passage. The housing is formed of a plurality of releasably connectable housing portions that together define the molding passage. The kit further includes a plunger element that includes a pressing surface on a first side thereof and a core element connector on a second side thereof. The kit further includes a core element having a core element passage therein and having a first end that is open to the core element passage.

The core element has at least a first connecting end that is releasably connectable to the core element connector so as to releasably connect the core element to the plunger element. The core element is sized to be inserted through one of the first and second axial ends of the housing and into the volume of the moldable material that is, in use, held within the molding passage so as to capture a core quantity of the moldable material for removal from the volume of the moldable material that is, in use, in the molding passage. The plunger element is sized to be insertable through one of the first and second axial ends and into the molding passage by a person holding the core element as a handle to extrude an extruded quantity of the moldable material out through the other of the first and second axial ends of the housing.

BRIEF DESCRIPTION OF THE DRAWINGS

Embodiments will now be described, by way of example only, with reference to the attached Figures, wherein.

DETAILED DESCRIPTION OF THE EMBODIMENTS

The kit for forming crafts from a moldable material includes a housing having a molding passage therethrough, a plunger head and at least one core element. The kit as presented herein includes a housing having a molding passage therethrough for holding a volume of the moldable material. The housing has a first axial end that is open to the molding passage and a second axial end that is also open to the molding passage. The housing is formed of plurality of releasably connectable housing portions that together, define the molding passage of the housing.

In the kit as presented herein, the moldable material to be molded by the kit to form a craft may be, for example, the product that is sold by Spin Master Ltd. under the name Kinetic Sand™, a putty, a clay, a dough, or any other suitable moldable material. The moldable material may be stored in a canister or other container that may be included with the kit.

Figure 1:
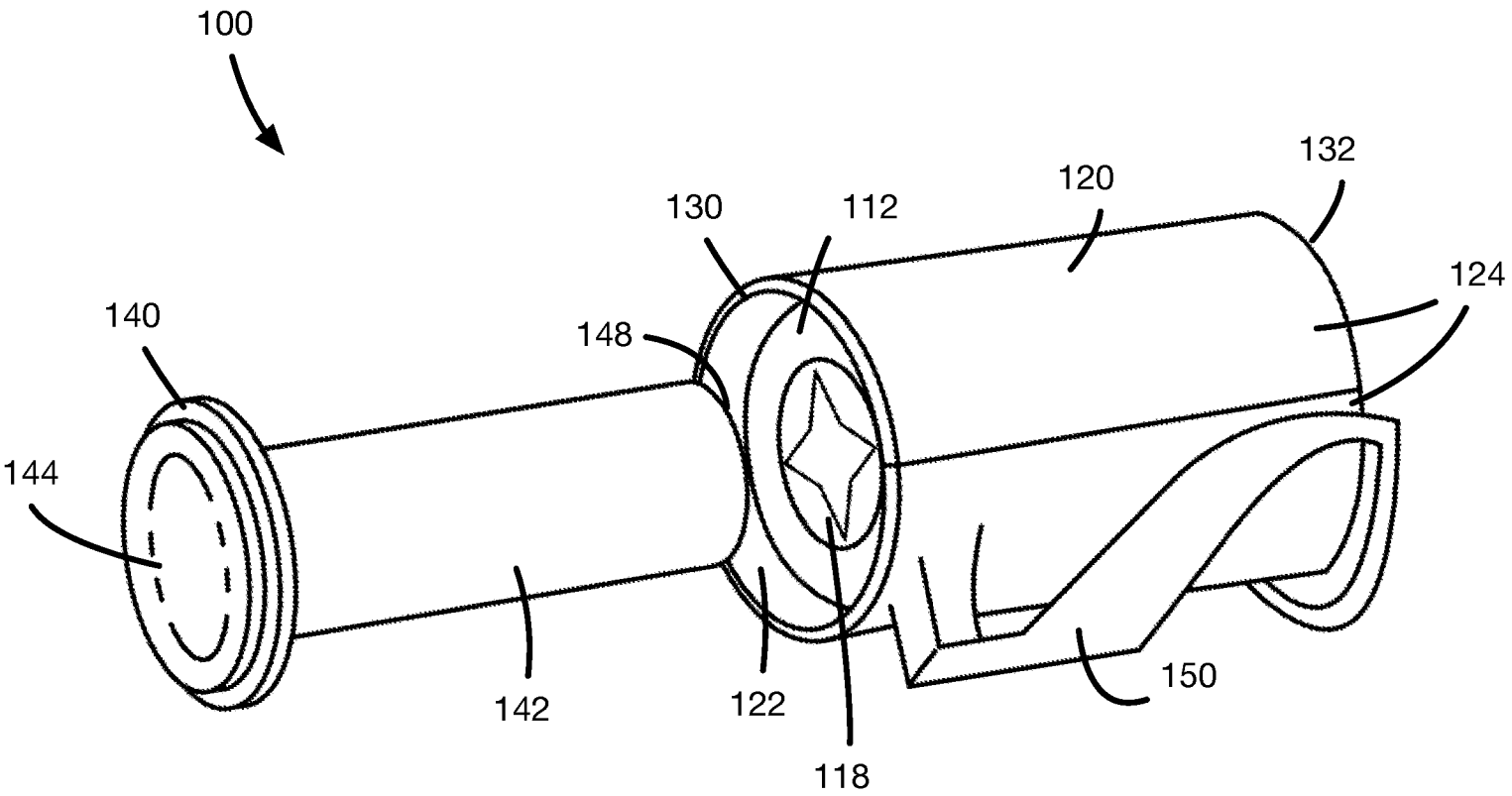
FIG. 1 shows an embodiment of the invention including a cylindrical housing and an integrally formed plunger element and core element.

In the exemplary embodiments provided in FIG. 1 and FIG. 2, the housing is in the form of a cylindrical housing 120, having a molding passage 122 extending therethrough for holding a volume of the moldable material 112. The cylindrical housing 120 is formed such that there are the first and second axial ends (130, 132) that are open to the molding passage 122. In this embodiment, the cylindrical housing 120 is formed by a pair of releasably connectable, semi-cylindrical portions 124. The two semi-cylindrical portions 124 are separably connectable and can be connected to form the cylindrical housing 120, where the connected portions 124 will have an opening at each end thereof. The two semi-cylindrical portions 124 fit together such that when connected, the two semi-cylindrical portions 124 define an inner diameter of the cylindrical housing 120.

In the embodiments of FIG. 1 and FIG. 2, the cylindrical housing 120 includes a base support 150 mounted to a region of the outer surface of the cylindrical housing 120, where the support 150 facilitates the resting of the cylindrical housing 120 on a flat surface while preventing the housing 120 from rolling around on the surface while it is in use.

In the embodiment shown in FIGS. 1 and 2, the base support 150 is in the form of a continuous member that is integrally formed on one of the two semi-cylindrical portions. The base support 150 has a form so as to provide contact points on either longitudinal end of the housing 120, where the contact points are the points of the support 150 that rest on a flat surface to stabilize the housing 120.

In an alternative embodiment, the base support can be formed of a plurality of members that project outwards from the housing, where at least one of the plurality of members is integrally formed on each of the plurality of housing portions.

In a further embodiment, the molding passage 122 defines a longitudinal axis for the housing 120, and the plurality of housing portions 124 are connected to one another along a first side thereof. The plurality of housing portions 124 are releasably latched together on a second side thereof to facilitate opening of the housing 120 to expose the volume of moldable material 112.

Figure 4:
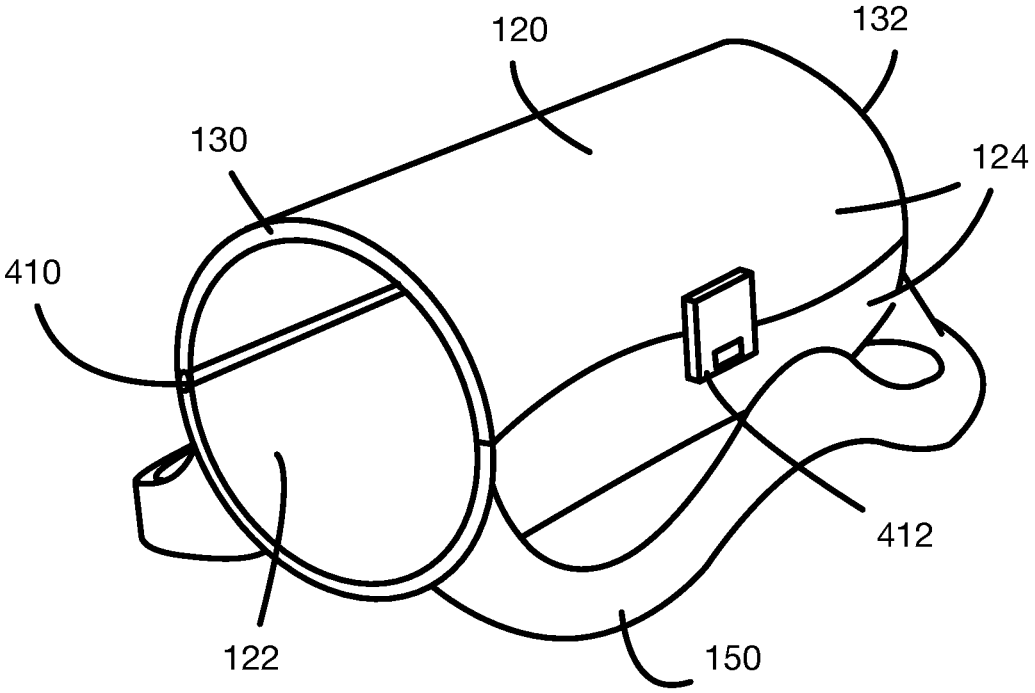
FIG. 4 shows an embodiment of the cylindrical housing with a hinge and latch mechanism.

In the exemplary embodiment provided in FIG. 4, the housing is a cylindrical housing 120 comprising the two semi-cylindrical portions 124. The pair of semi-cylindrical portions 124 are connected by a hinge joint 410 positioned along a longitudinal edge of each portions 124. The hinge joint 410 allows for the controlled separation and closure of the pair of semi-cylindrical portions 124 to form the cylindrical housing 120. At least one of the semi-cylindrical portions 124 may be pivoted about the hinge joint 410 to come into contact with the other semi-cylindrical portion.

As shown in FIG. 4, one of the two semi-cylindrical portions 124 includes a male latching element along the longitudinal edge thereof opposite the longitudinal edge of the semi-cylindrical portion 124 that includes the hinge connection. The other of the two semi-cylindrical portions 124 includes a female latching groove on a corresponding longitudinal side thereof. The male latching element and the female latching groove engage with one another to form a latch connection 412 to releasably secure the semi-cylindrical portions 124 together. In the embodiment show in FIG. 4, the pivoting of the body about the hinge causes the latch connection 412 secure the portions 124 together.

In an embodiment, each of the two semi-cylindrical portions 124 do not makeup equal portions 124 of the cylindrical housing 120. For example, one of the semi-cylindrical portions 124 is formed to comprise two-thirds of the cylindrical housing 120 circumference, while the other of the semi-cylindrical portions 124 constitutes the remaining one-third of the circumference of the cylindrical housing 120.

In an embodiment, the kit 100 comprises a plunger element having a pressing surface on a first side thereof and a core element extending from an opposing, second side thereof. The core element has a core element passage therein and a first end that is open to the core element passage. The core element is sized to be inserted through one of the first and second axial ends of the housing and into the volume of the moldable material 112 that is, in use, held within the molding passage so as to capture a core quantity 118 of the moldable material within the core element passage for removal from the volume of the moldable material that is in the molding passage. The plunger is also sized to be inserted through one of the first and second axial ends and into the molding passage to extrude an extruded quantity of the moldable material out through the other of the first and second axial ends of the housing.

In the embodiment provided in FIG. 1, the kit 100 for forming crafts from a moldable material includes a cylindrical housing 120 (as described above) and includes a disk-shaped plunger element 140 having a pressing surface 144 on a first side thereof. In this embodiment, the core element is a cylindrical core element 142 that is integrally formed with the plunger element 140, and extends out from a second side thereof. The core element 142 has the core element passage therein (not shown) with an end 148 open to the passage. The cylindrical core element 142 has an outer diameter that is sized to be inserted through one of the first and second axial end (130, 132) of the housing 120 and into the volume of the moldable material to capture and remove a core quantity 118 of the moldable material. The outer diameter of the plunger element 140 is also sized to be inserted through one of the first and second axial ends (130, 132) and into the molding passage 122 to extrude an extruded quantity of the moldable material, where the pressing surface 144 will contact and extrude out the extruded quantity of the moldable material.

In an embodiment, the length of the core element 142 is approximately at least as long as a length of the cylindrical housing. Although FIG. 1 depicts an integral core element 142 with a circular cross section, the integral core element 142 may have a variety of cross sections including but not limited to hollow cross-sections shaped as a square, a triangle, a pentagon or a star shape.

In an alternate embodiment, the kit for forming a craft from a moldable material comprises a plunger element with a pressing surface on a first side thereof and a core element connector on a second side thereof. The kit also comprises a core element having a core element passage therein and having a first end that is open to the core element passage, the core element also includes at least a first connecting end that is releasably connectable to the core element connector so as to releasably connect the core element to the plunger element.

Figure 2A:
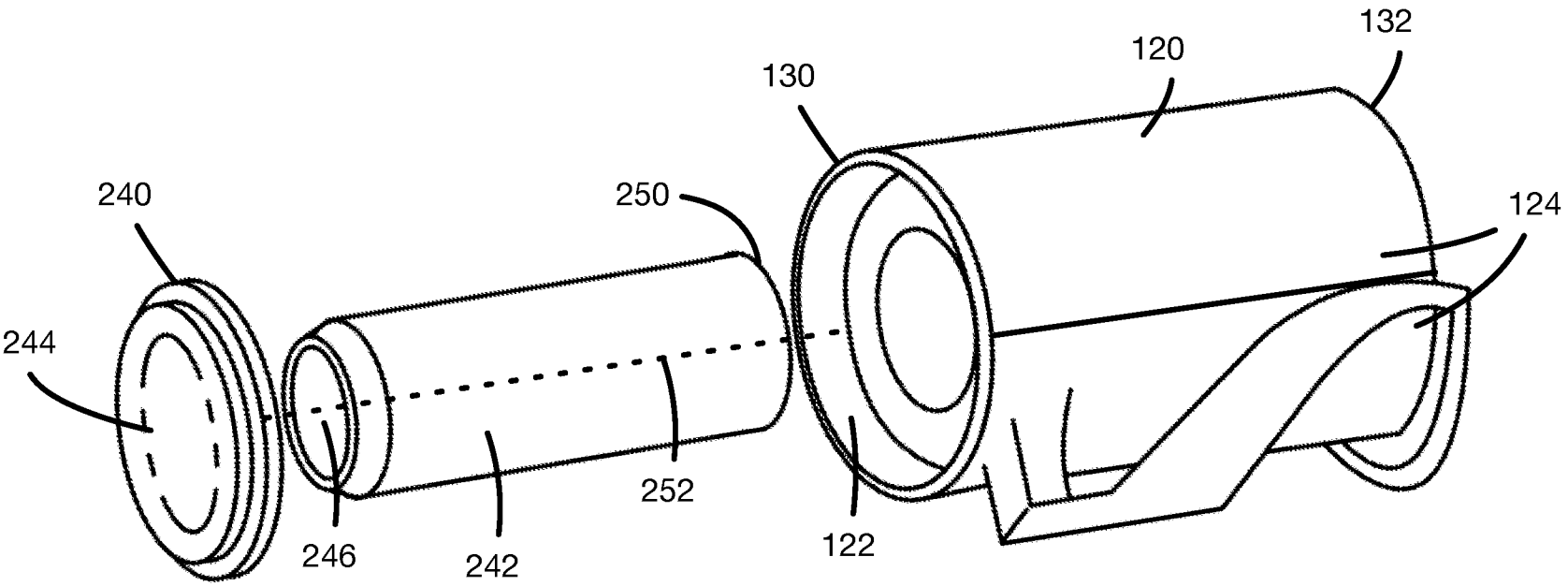
FIG. 2A shows an embodiment of the invention including a cylindrical housing and a separable plunger element and core element.
Figure 2B:
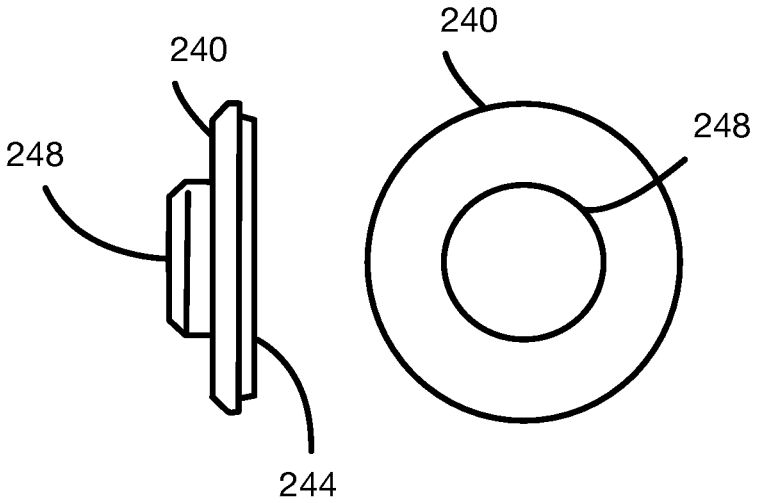
FIG. 2B shows an embodiment of the separable plunger element.

In the specific example provided in FIG. 2A, the kit 200 for forming crafts from a moldable material includes a housing (as described above) and includes a disk-shaped plunger element 240. As shown in FIG. 2B, the plunger element 240 includes a thin, pressing surface 244 on a first side thereof and a cylindrical, core element connector 248 on a second side thereof. In this embodiment, the diameter of the core element connector is less than that of the pressing surface 244 and a distal edge of the cylindrical, core element connector is tapered.

As shown in FIG. 2A, the kit 200 for forming crafts from a moldable material includes a core element that is separate from the plunger element 240. In this specific embodiment, the separate core element is a cylindrical core element 242 with a circular core element passage 246 therein, where the core element 242 has first and second ends that are open to the core element passage 246. One of the first and second ends is a connecting end that is releasably connectable to the core element connector of the plunger element 240 (See FIG. 2B) so as to releasably connect the core element to the plunger element 240. In this embodiment, the connecting end of the core element 242 includes an opening sized to receive and securely fit around the cylindrical, core element connector 248 of the plunger element.

As described above, the core element 242 is sized to be inserted through one of the first and second axial ends (130, 132) of the housing and into the volume of the moldable material 112 that is, in use, held within the molding passage 122 so as to capture a core quantity 118 of the moldable material for removal from the volume of the moldable material 112 in the molding passage 122. Similarly, the plunger element 240 is sized to be insertable through one of the first and second axial ends (130, 132) and into the molding passage 122 by a person holding the plunger element 240 as a handle to extrude an extruded quantity of the moldable material out through the other of the first and second axial ends (130, 132) of the housing.

Figure 2C:
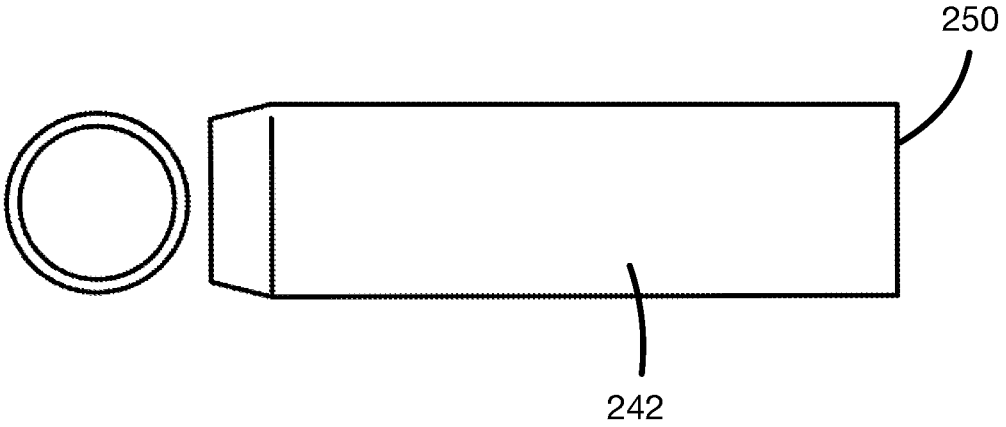
FIG. 2C shows an embodiment of the separable core element.

In the embodiments shown in FIGS. 2A and 2C, the connecting end of the core element 242 includes a tapered collar as part of the connecting end. In this embodiment, the tapered end has an opening therein that is the opening sized to receive and securely fit around the cylindrical, core element connector 248 of the plunger element 240. In the same embodiment the non-tapered end of the core element 242 has a second inner diameter that is greater than the first inner diameter.

In an embodiment, the cross-sectional form of the core element 242 is not circular, and the opening of the core element 242 that securely fits around the cylindrical, core element connector 248 is not defined by a continuous surface. For example, the core element 242 may have a star-shaped cross section, and the surface of the opening for receiving the core element connector is defined by the plurality of inner vertices of the star-shape.

In an embodiment, the connectable core element that is separable from the plunger element (as described above) is a first core element, and the kit for forming crafts from a moldable material further comprises a second core element having a core element passage therein and an end that is open to the core element passage. In this embodiment, the second core element is sized to be received around and to securely hold therein the first hollow core element to form a multi-element, core insertion member that is connectable to the connecting portion of the plunger head.

Figure 3:
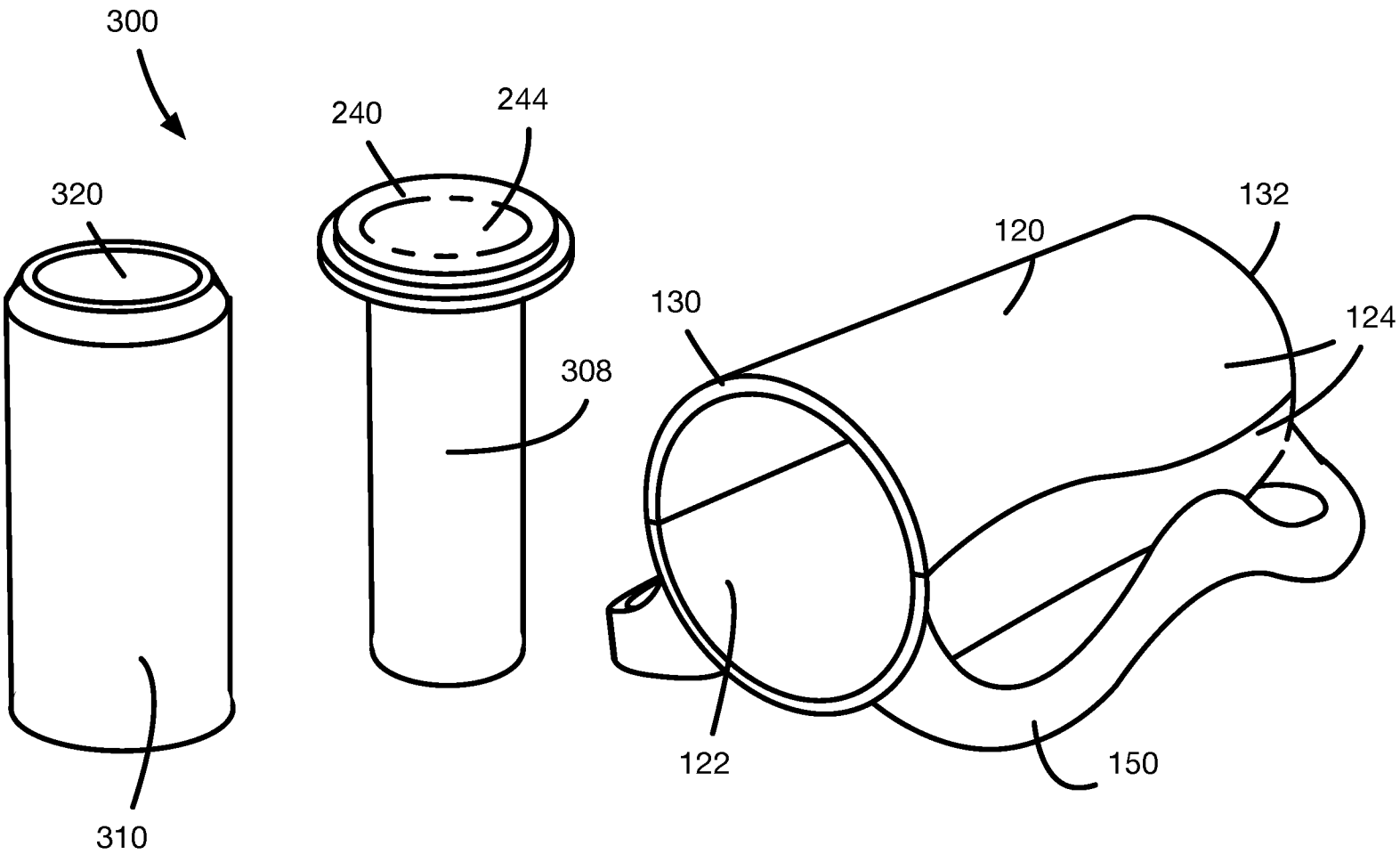
FIG. 3 shows an embodiment of the invention including the housing and first and second connectable core elements.

Referring to the specific example provided in FIG. 3, the kit 300 is shown to include a disk-shaped plunger element 240, a cylindrical first core element 308, and a cylindrical second core element 310 with a circular core element passage 320 therein and a connecting end that is open to the core element passage 320. In this embodiment, the connecting end of the cylindrical second core element 310 is sized to be received around and to securely hold therein the cylindrical first core element, to form a multi-element, core insertion member that is connectable to the core element connector 248 of the plunger element 240.

In this specific embodiment, the cylindrical second core element 310 includes a tapered collar on a first end thereof that defines the connecting end of the second core element 310. The opening in the tapered, connecting end is sized to securely fit around an outer diameter of the cylindrical first core element 308.

Figure 5:
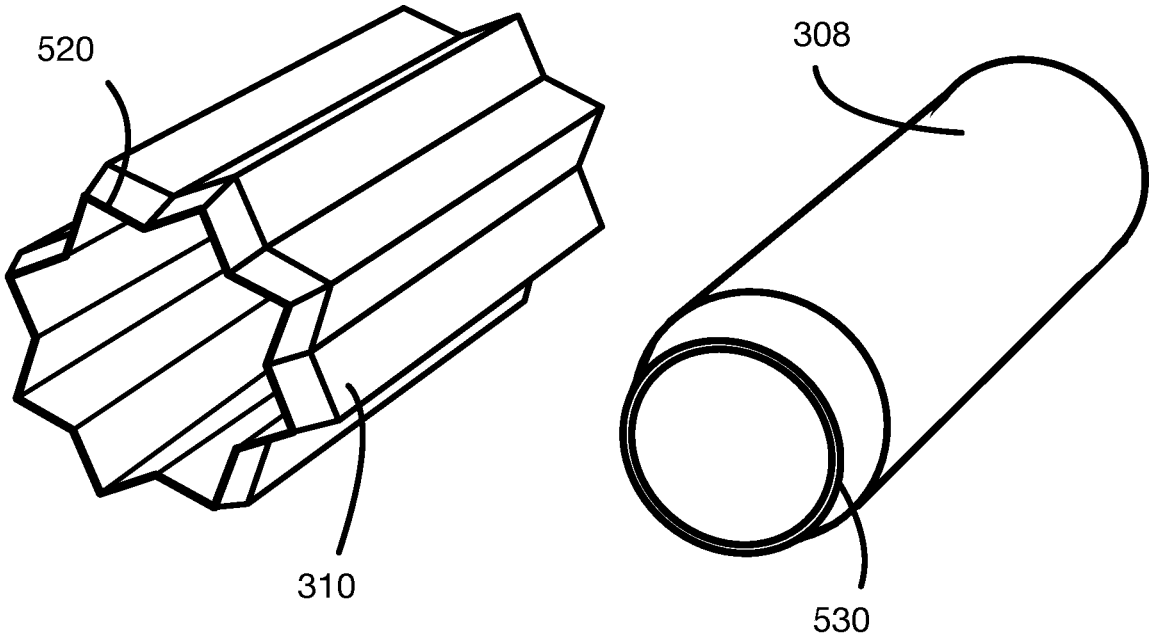
FIG. 5 shows an additional embodiment of the first and second connectable core elements.

Referring to the specific example provided in FIG. 5, the first core element 308 is removably connectable to the core element connector 248 of the plunger element 240, and the second core element 310 is removably connectable to the first core element 308. In this embodiment, the second core element 310 has a cross section in the form of a star 520, where the form of the star includes a plurality of tips with a corresponding, star shaped opening in a central region of the core element that defines the core element passage 320. In this same embodiment, the first core element 308 has a cross-section in the form a circle 530 with a circular opening in a central region thereof that defines the core element passage 320. In this embodiment, the inner diameter of the second core element 310 is defined by the plurality of inner vertices of the star-shaped cross section of the core element 310. The inner diameter is sized such that the plurality of inner vertices contact an outer surface of the first core element 308 for securely holding the second core element 310 around the first core element 308.

In an embodiment, the kit (100, 200, 300) for forming a craft from a moldable material further comprises a cutting member. The cutting member is shaped to separate a section of the portion of the volume of moldable material 112 that is extruded out the opposing end of the cylindrical housing.

Figure 6A:
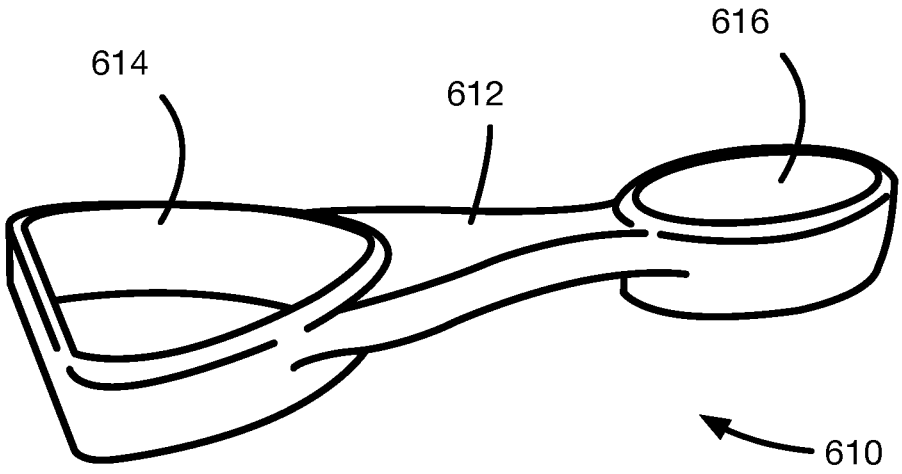
FIG. 6A shows an embodiment of the cutter member included in the kit for forming crafts of the moldable material.
Figure 6B:
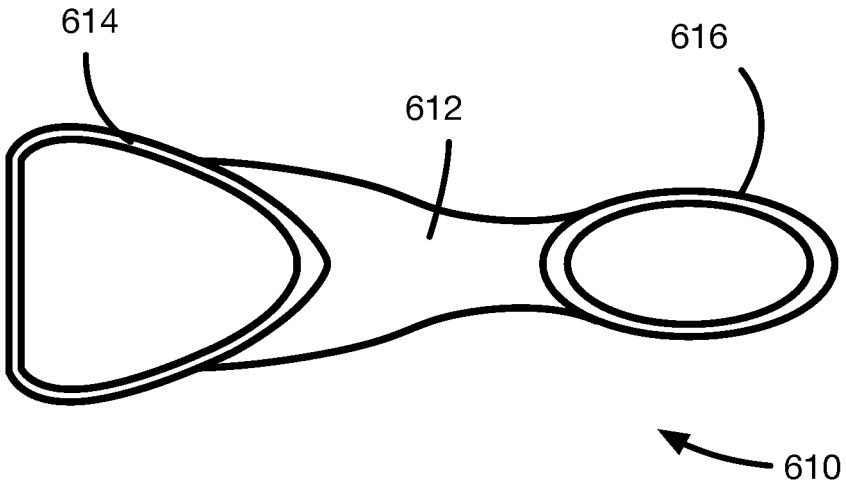
FIG. 6B shows a top view of the embodiment of the cutter member shown in FIG. 6A.

In the exemplary embodiment provided in FIG. 6A and FIG. 6B, the cutting member 610 is a cutting tool including a handle portion 612 and first and second hollow carving loops 614, 616 extending from first and second ends of the handle portion 612. The hollow and closed form of the carving loops 614, 616 facilitates slicing of moldable material and the separation of sections of the moldable material. The cutting member 610 is formed to separate a section of the volume of the moldable material 112 that is, in use, held within the molding passage 122 of the housing.

Figure 7:
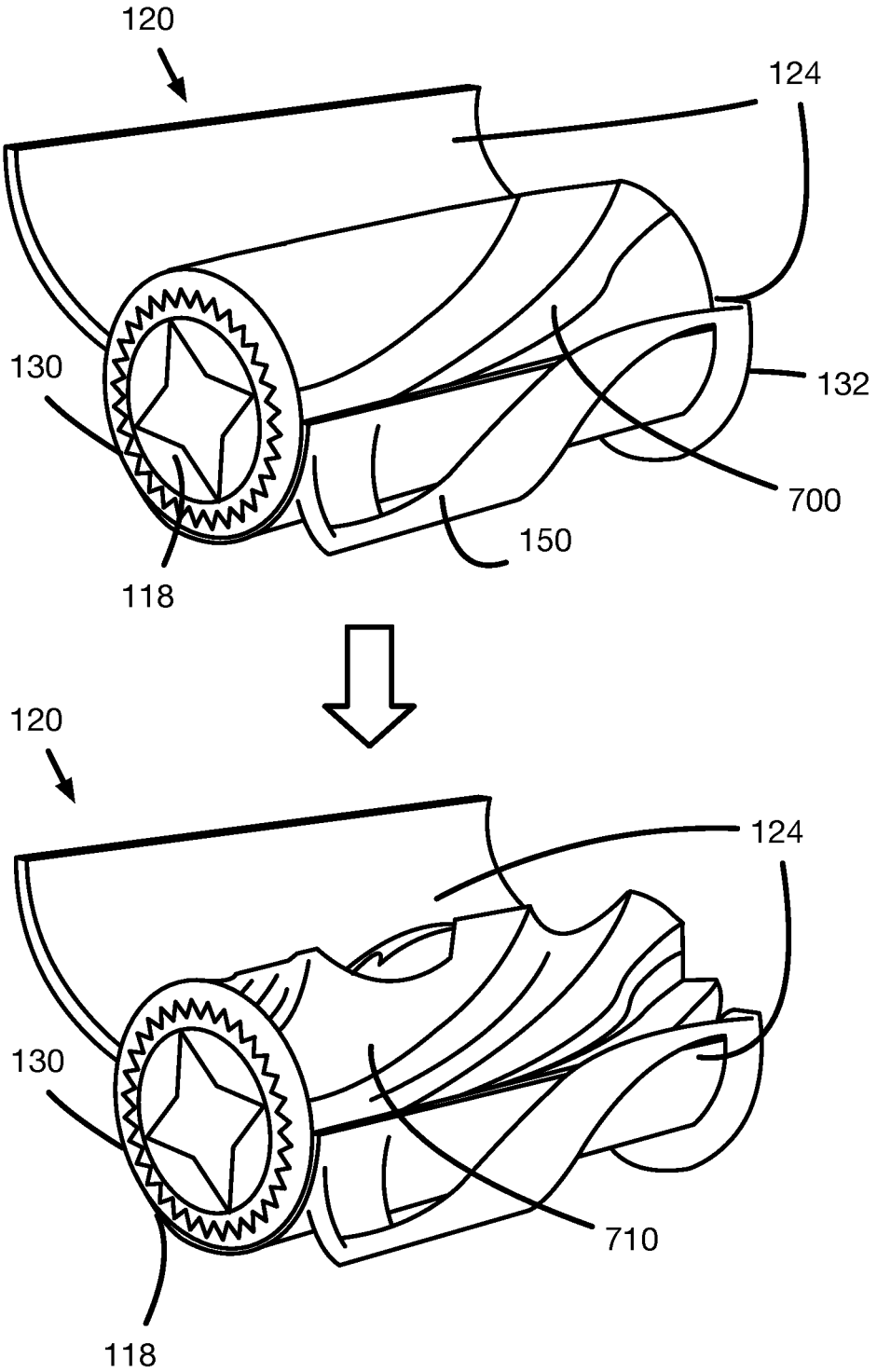
FIG. 7 is an exemplary diagram that depicts the results of the cutting member being used to remove moldable material from a volume of moldable material held in the housing.

As shown in the exemplary diagram provided in FIG. 7, the housing may be a cylindrical housing holding a cylindrical volume of moldable material 700. The hingedly attached, semi-cylindrical portions 124 of the housing 120 can be separated to expose the side faces of the cylindrical volume of moldable material 700 in the molding passage 122 of the housing 120. In this embodiment, the cutting member 610 is used to remove sections of the volume of moldable material 112 to form a carved volume of moldable material 710 in the molding passage 122. The carved sections in the volume of moldable material 710 may be left open or may be replaced with other slices of moldable material having different colors or patterns. By inserting these different slices, the volume of moldable material 112 held in the cylindrical housing 120 is provided with variety in its designs along its length. This variety will produce more variations in the designs of the sections of the moldable material that are extruded out of the cylindrical housing 120.

The above-described embodiments are intended to be examples of the present invention and alterations and modifications may be effected thereto, by those of skill in the art, without departing from the scope of the invention that is defined solely by the claims appended hereto.

What is claimed is:

1. A kit for forming crafts from a moldable material, comprising:

a housing having a molding passage therethrough for holding a volume of the moldable material, the housing having a first axial end that is open to the passage and a second axial end that is open to the molding passage, and being formed of a plurality of releasably connectable housing portions that together define the molding passage; and a plunger element including a pressing surface on a first side thereof and a core element extending from an opposing, second side thereof, the core element having a core element passage therein and having a first end that is open to the core element passage, the core element being sized to be inserted through one of the first and second axial ends of the housing and into the volume of the moldable material that is, in use, held within the molding passage so as to capture a core quantity of the moldable material within the core element passage for removal from the volume of the moldable material that is in the molding passage, the plunger being sized to be inserted through one of the first and second axial ends and into the molding passage to extrude an extruded quantity of the moldable material out through the other of the first and second axial ends of the housing;

wherein the core element is a first core element and the kit further comprises a second core element having a core element passage therein and an end that is open to the core element passage, the second core element being sized to be received around and to securely hold therein the first hollow core element to form a multi-element, core insertion member.

2. A kit for forming crafts from a moldable material, comprising:

a housing having a molding passage therethrough for holding a volume of the moldable material, the housing having a first axial end that is open to the passage and a second axial end that is open to the molding passage, and being formed of a plurality of releasably connectable housing portions that together define the molding passage;

a plunger element including a pressing surface on a first side thereof and a core element connector on a second side thereof; and a core element having a core element passage therein and having a first end that is open to the core element passage, the core element having at least a first connecting end that is releasably connectable to the core element connector so as to releasably connect the core element to the plunger element, wherein the core element is sized to be inserted through one of the first and second axial ends of the housing and into the volume of the moldable material that is, in use, held within the molding passage so as to capture a core quantity of the moldable material for removal from the volume of the moldable material that is, in use, in the molding passage, and wherein the plunger element is sized to be insertable through one of the first and second axial ends and into the molding passage by a person holding the core element as a handle to extrude an extruded quantity of the moldable material out through the other of the first and second axial ends of the housing;

wherein the core element is a first core element and the kit further comprises a second core element having a core element passage therein and an end that is open to the core element passage, the second core element being sized to be received around and to securely hold therein the first hollow core element to form a multi-element, core insertion member.

3. A kit for forming crafts from a moldable material according to claim 1, wherein the first core element has a cross section in the form of a star including a plurality of tips with an opening in a central region thereof that defines the core element passage.

4. A kit for forming crafts from a moldable material according to claim 1, wherein the molding passage is generally cylindrical.

5. A kit for forming crafts from a moldable material according to claim 1, further comprising a cutting member shaped to separate a section of the portion of the volume of moldable material that is extruded out the opposing end of the cylindrical housing.

6. A kit for forming crafts from a moldable material according to claim 1, wherein the molding passage defines a longitudinal axis for the housing, and the plurality of housing portions are hingedly connected to one another along a first side thereof, and are releasably latched together on a second side thereof so as to permit opening of the housing to expose the volume of moldable material during use.

7. A kit for forming crafts from a moldable material according to claim 3, wherein the second core element has a cross-section in the form a circle with an opening in a central region thereof that defines the core element passage.

8. A kit for forming crafts from a moldable material according to claim 2, wherein the first core element has a cross section in the form of a star including a plurality of tips with an opening in a central region thereof that defines the core element passage.

9. A kit for forming crafts from a moldable material according to claim 2, wherein the molding passage is generally cylindrical.

10. A kit for forming crafts from a moldable material according to claim 2, further comprising a cutting member shaped to separate a section of the portion of the volume of moldable material that is extruded out the opposing end of the cylindrical housing.

11. A kit for forming crafts from a moldable material according to claim 2, wherein the molding passage defines a longitudinal axis for the housing, and the plurality of housing portions are hingedly connected to one another along a first side thereof, and are releasably latched together on a second side thereof so as to permit opening of the housing to expose the volume of moldable material during use.

12. A kit for forming crafts from a moldable material according to claim 8, wherein the second core element has a cross-section in the form a circle with an opening in a central region thereof that defines the core element passage.

* * * * *